US008757635B2

(12) United States Patent
Christofilis et al.

(10) Patent No.: US 8,757,635 B2
(45) Date of Patent: Jun. 24, 2014

(54) DEVICES, SYSTEMS AND METHODS FOR SECURING A STAKE

(75) Inventors: Tom J. Christofilis, Oakbrook Terrace, IL (US); Constantine S. Grapsas, Oak Brook, IL (US)

(73) Assignee: AIM , Inc., Addison, IL (US)

( * ) Notice: Subject to any disclaimer, the term of this patent is extended or adjusted under 35 U.S.C. 154(b) by 262 days.

(21) Appl. No.: 13/035,982

(22) Filed: Feb. 27, 2011

(65) Prior Publication Data

US 2012/0217709 A1 Aug. 30, 2012

(51) Int. Cl.
*B25F 3/00* (2006.01)

(52) U.S. Cl.
USPC ..... 279/145

(58) Field of Classification Search
USPC ..... 29/432.1, 453, 451, 469, 225, 227, 240, 29/240.5, 270; 279/145, 143, 142
See application file for complete search history.

(56) References Cited

U.S. PATENT DOCUMENTS 7,823,267 B2 * 11/2010 Bolduc ..... 29/525.01

FOREIGN PATENT DOCUMENTS

JP 2001041217 * 2/2001

* cited by examiner

*Primary Examiner* — John C Hong
(74) *Attorney, Agent, or Firm* — Moazzam & Associates, LLC

(57) ABSTRACT

Devices, systems, and methods are disclosed which relate to a stake that is twisted into and out of the ground via an adaptor. The adaptor adapts the stake to a power drill, allowing the power drill to twist the stake into and out of the ground by activating the drill. The adaptor is designed to fit a standard drill chuck at one end. At the other end, the adaptor has a fitting to receive the stake. The fitting is such that the stake and adaptor are axially locked so that the stake and adaptor rotate in unison when the drill is activated. The stake is a wire designed in a coil shape with a pilot. The pilot is fit into the adaptor which axially locks the stake with the adaptor.

14 Claims, 5 Drawing Sheets

DEVICES, SYSTEMS AND METHODS FOR SECURING A STAKE

BACKGROUND OF THE INVENTION

1. Field of the Invention

The present invention relates to ground stakes. More specifically, the present invention relates to a power-driven ground stake.

2. Background of the Invention

Today there are many types of stakes. Stakes are used in gardening, landscaping, and camping. Tent stakes are nearly as important as the tent itself. Today's tents are often designed to withstand the elements, keeping occupants protected from changes in weather. However, they are not built to stand up against much wind. As such, tent stakes are vital for keeping one's tent on the ground.

Traditionally, tent stakes are made of plastic, metal, or wood. Each type is designed for use in certain types of terrain. For example, small diameter titanium stakes are designed for use in hard dirt. These stakes should not be used when pitching a tent on sand or for snow camping.

Another type of tent stake, bulky angle iron or aluminum stakes, are useful for camping in the sand. This type of stake, however, is far from effective for use in hard dirt. Furthermore, these tent stakes are known to lose their effectiveness in rainy conditions.

Large plastic tent stakes are often used for family camping. These tent stakes are both lightweight and tough, most featuring a large head for easier pounding into the ground. These stakes are generally less expensive than many other types. However, exposure to ultraviolet light may degrade plastic stakes, necessitating an eventual replacement.

Skewer tent stakes are lightweight and inexpensive. These stakes are straight in shape and are not the best option when holding power is vital. Generally speaking, skewer stakes work the best in grassy terrain. By contrast, bulldog tent stakes are heavier and more capable of holding fast. Bulldog stakes don't bend easily and work well in a variety of ground types.

Snow stakes are designed to be buried sideways in the snow. These stakes are stronger than those designed for general use. Some anchor stakes are designed for use in both snow and sand. Anchor stakes are made to be filled with snow or sand and buried in the ground.

Wooden tent stakes are frequently used for securing group tents. They are generally thick and have a higher level of holding power than other types. Typically, wooden tent stakes are driven into the ground using a mallet.

Tents have many more uses than camping. Large tents or marquees may serve as temporary buildings for businesses, traveling shows such as circuses, military camps, etc. These tents require a lot of man hours to assemble and tens or hundreds of stakes. Each of these stakes is still driven manually, soaking up a bulk of the man hours.

What is needed in the art is a stake that can be driven into the ground quickly and easily, yet does not complicate the manufacturing of the stake.

SUMMARY OF THE INVENTION

The present invention addresses the problems highlighted above by introducing a stake that is twisted into and out of the ground via an adaptor. The adaptor adapts the stake to a power drill, allowing the power drill to twist the stake into and out of the ground by activating the drill. In exemplary embodiments, the adaptor is designed to fit a standard drill chuck at one end.

At the other end, the adaptor has a fitting to receive the stake. The fitting is such that the stake and adaptor are axially locked so that the stake and adaptor rotate in unison when the drill is activated. The stake is a wire designed in a coil shape with a pilot. The pilot is fit into the adaptor which axially locks the stake with the adaptor.

In one exemplary embodiment, the present invention is a device for securing a stake into the ground. The device includes an adaptor attachable to a drill, a stake receiver coupled with the adaptor, the stake receiver receiving the stake such that the stake is axially locked with the adaptor, a stake insertable into the stake receiver, the stake having a first end insertable into the ground, and a second end having a pilot insertable into the stake receiver. The drill turns the adaptor and the stake in unison on an axis of rotation.

In another exemplary embodiment, the present invention is a system for securing a stake into the ground. The system includes a drill, an adaptor attachable to the drill, a stake receiver coupled with the adaptor, the driver for driving a stake into the ground, a stake attachable to the stake receiver, the stake being a coil having a first end insertable into the ground, and a second end having a pilot attachable to the stake receiver. The drill turns the adaptor and stake in unison on an axis of rotation.

In yet another exemplary embodiment, the present invention is a method for securing a stake into the ground. The method includes attaching an adaptor to a drill, the adaptor including a stake receiver, the stake receiver for guiding the stake, attaching the stake to the stake receiver, the stake being a coil having a first end insertable into the ground, and a second end having a pilot attachable to the stake receiver, positioning the first end of the stake on the ground with the drill substantially above the stake, and activating the drill, which turns the adaptor along an axis of rotation driving the stake into the ground.

DETAILED DESCRIPTION OF THE INVENTION

The present invention addresses the problems highlighted above by introducing a stake that is twisted into and out of the ground via an adaptor. The adaptor adapts the stake to a power drill, allowing the power drill to twist the stake into and out of the ground by activating the drill. In exemplary embodiments, the adaptor is designed to fit a standard drill chuck at one end. At the other end, the adaptor has a fitting to receive the stake. The fitting is such that the stake and adaptor are axially locked so that the stake and adaptor rotate in unison when the drill is activated. The stake is a wire designed in a coil shape with a pilot. The pilot is fit into the adaptor which axially locks the stake with the adaptor.

"Stake," as used herein and throughout this disclosure, refers to any apparatus which is inserted into the ground or terrain for the purpose of supporting a structure. Examples of stakes include tent stakes, garden stakes, Christmas decoration stakes, etc.

"Drill," as used herein and throughout this disclosure, refers to any powered device used to rotate tools, fasteners, etc. Drills are commonly used to bore out holes and insert fasteners, but have many other applications. Drills can be handheld or supported. Most drills use a chuck that secures tools having a hexagonal cylinder, but other tool connections exist and many more are possible. Examples of drills include powered screw-drivers, DREMEL tools, or anything else that rotates.

For the following description, it can be assumed that most correspondingly labeled structures across the figures (e.g., 104 and 204 and 304, etc.) possess the same characteristics and are subject to the same structure and function. If there is a difference between correspondingly labeled elements that is not pointed out, and this difference results in a non-corresponding structure or function of an element for a particular embodiment, then that conflicting description given for that particular embodiment shall govern.

Figure 1:
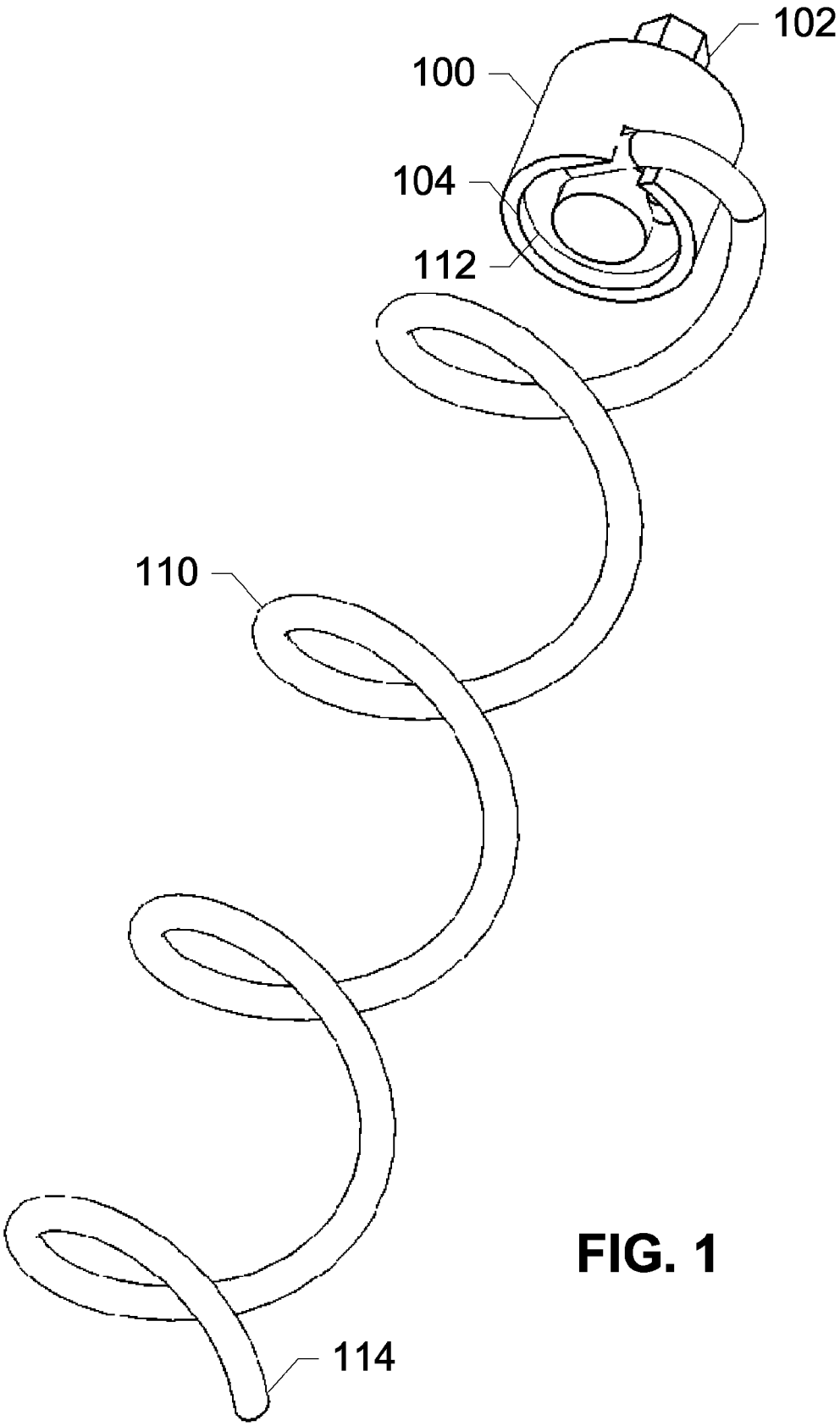
FIG. 1 shows an isometric view of an assembly of a stake and an adaptor, according to an exemplary embodiment of the present invention.

FIG. 1 shows an isometric view of an assembly of a stake 110 and an adaptor 100, according to an exemplary embodiment of the present invention. The assembly includes stake 110 having a pilot 112 and an end 114, and adaptor 100 having a stake receiver 104 and a drill insert 102. Pilot 112, at the top of stake 110, is inserted into stake receiver 104 of adapter 100. Adaptor 100 connects to a drill by inserting drill insert 102 into the chuck of a drill. In this exemplary embodiment, drill insert 102 is a standard hexagonal cylinder. When the drill is activated, the chuck turns, rotating adaptor 100 and stake 110. The walls of stake receiver 104 lock the stake axially with respect to the adaptor to drive the stake rotationally.

The adaptor and the stake are made from strong and rigid materials, such as steel and other metals. The two main connections in the assembly are the pilot/stake receiver connection and the drill insert/chuck connection. Though shown to be different, these connections share the effect of axial locking. Many different types of connectors using different shapes and features are possible and applicable so long as the connection results in axial locking, and the connection is strong enough to resist failure during power driving. The following provides more details on these connections and variations thereof.

Figure 2A:
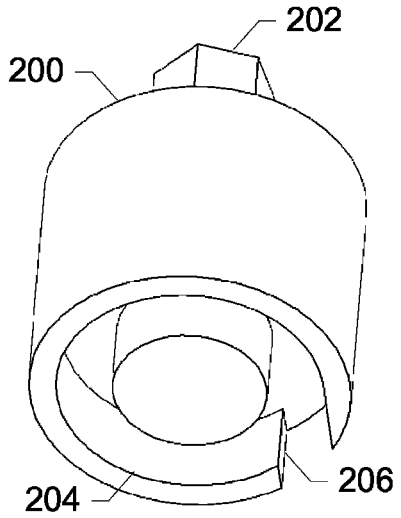
FIG. 2A shows an isometric view of an adaptor for fitting a stake and a drill, according to an exemplary embodiment of the present invention.

FIG. 2A shows an isometric view of an adaptor 200 for fitting a stake and a drill, according to an exemplary embodiment of the present invention. Adaptor 200 includes a drill insert 202, a stake receiver 204, and a key notch 206. The chuck of a drill receives drill insert 202 to axially lock adaptor 200 and the chuck. In this exemplary embodiment, drill insert 202 is a standard hexagonal cylinder. A stake having a pilot is inserted into stake receiver 204 so that the pilot fits inside the outer wall of stake receiver 204. The pilot spirals out to the larger coil that makes up the body of the stake. Key notch 206 is an opening in the outer wall of stake receiver 204. Key notch is sized to match the wire making up the stake, and, as such, axially locks the stake with adaptor 200 to prevent the pilot from rotating within adaptor 200 when the stake is being driven into the ground.

Figure 2C:
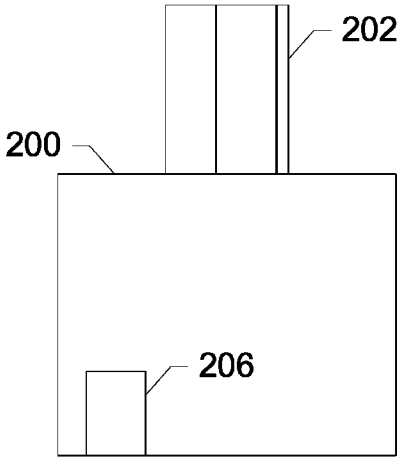
FIG. 2C shows a front view of an adaptor, according to an exemplary embodiment of the present invention.
Figure 2B:
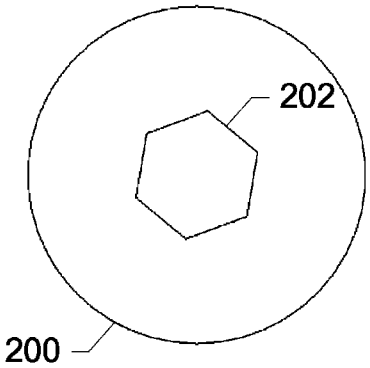
FIG. 2B shows a top view of an adaptor, according to an exemplary embodiment of the present invention.

FIG. 2B shows a top view of an adaptor 200, according to an exemplary embodiment of the present invention. Adaptor 200 includes drill insert 202. This view highlights the shape of the cross section of drill insert 202, which is a hexagon. In other embodiments, the shape of the cross section of drill insert 202 is different. The shape depends on the type of chuck of a drill receiving drill insert 202. The chuck may receive square, triangular, or even star-shaped cross sections such as in TORX screws, etc. Even if the chuck is designed to receive hexagonal cross sections, an adaptor can be used to adapt the shape from hexagonal to the shape of the cross section of drill insert 202.

FIG. 2C shows a front view of an adaptor 200, according to an exemplary embodiment of the present invention. Adaptor 202 includes drill insert 202 and key notch 206. In this view, key notch 206 is shown as a cutout of the exterior wall of adaptor 202. Key notch 206 allows a space for the pilot to connect to the rest of the stake in a continuous coil. Without key notch 206, the coil would require extra bends. Extra bends may add flexibility to the coil. However, when driving the coil, a less flexible structure makes the driving process easier. The size and shape of key notch 206 are dependent on the stake. The stake should slide easily into and out of key notch 206. When driving the stake into the ground, key notch 206 fixes the stake axially with respect to adaptor 200. As such, key notch 206 is preferably sized so that there is minimal space between the sides of key notch 206 and the stake.

Figure 2D:
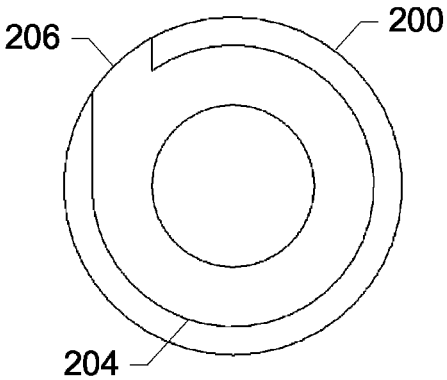
FIG. 2D shows a bottom view of an adaptor, according to an exemplary embodiment of the present invention.

FIG. 2D shows a bottom view of an adaptor 200, according to an exemplary embodiment of the present invention. Adaptor 200 includes stake receiver 204 and key notch 206. In this embodiment, stake receiver 204 is circular to match a circular pilot. With a circular stake receiver 204, key notch 206 is necessary to axially fix the stake with adaptor 200 while the stake is being driven into the ground.

In other embodiments, the stake receiver takes other shapes, such as square, hexagonal, triangular, etc. With a square or hexagonal shape, the need for the key notch diminishes. While the key notch may still provide for easier manufacturing of the stake, the key notch is not necessary to axially fix the stake with the adaptor if the stake receiver has a square shape. Other shapes result in this same effect. Some shapes are better for axial fixation than others as will be apparent to those having skill in the art.

Figure 3A:
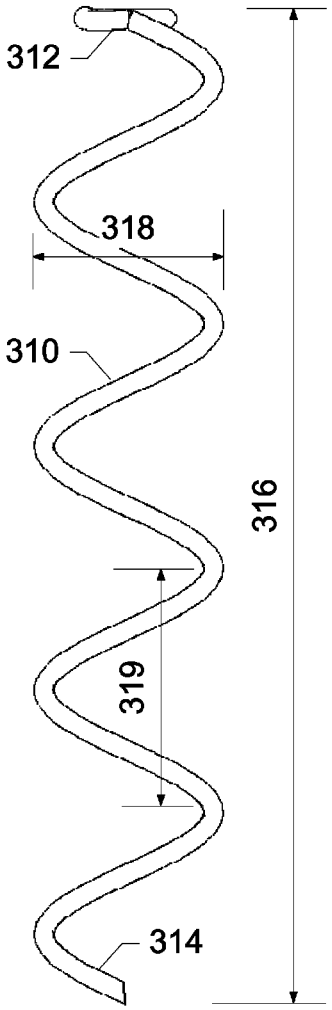
FIG. 3A shows a side view of a stake, according to an exemplary embodiment of the present invention.

FIG. 3A shows a side view of a stake 310, according to an exemplary embodiment of the present invention. Stake 310 includes a pilot 312, an end 314, a length 316, a diameter 318, and a pitch 319. In this exemplary embodiment, stake 310 is manufactured from a single wire. The wire is coiled according to diameter 318 and pitch 319, and cut to length 316. Pilot 312 is at the top of stake 310 opposite end 314. Length 316, diameter 318, and pitch 319 all change with the ground condition. Softer ground may require a longer length 316, as well as a greater diameter 318 and pitch 319. However, harder ground may require a smaller diameter 318, and not require as much length 316 and pitch 319. Those having skill in the art will recognize useful dimensions upon reading this disclosure.

In this embodiment, stake 310 is made from stainless steel wire. Other materials may be suitable depending on the ground condition and application. The thickness of the wire used to make the stake can be increased in lieu of using a stronger material. However, increasing the thickness may make the driving process more difficult due to the increased volume of earth that must be displaced to accommodate the stake. In further embodiments, the stake is manufactured through methods other than wire bending, such as thermoforming, etc. Different materials may yield to different manufacturing methods, as will become apparent to those having skill in the art upon reading this disclosure.

Figure 3B:
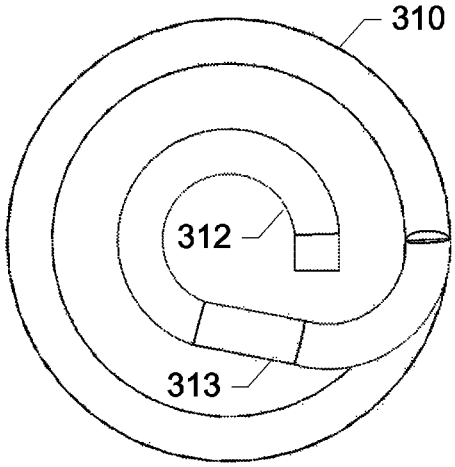
FIG. 3B shows a top view of a stake, according to an exemplary embodiment of the present invention.

FIG. 3B shows a top view of a stake 310, according to an exemplary embodiment of the present invention. Stake 310 includes a pilot 312 and notch portion 313 at the top. As can be seen from this view, wire from the stake is bent into a tighter curve at the top, forming pilot 312. Pilot 312 fits into a stake receiver of an adaptor for a drill. Notch portion 313 is the part of stake 310 which fits into a key notch of an adaptor for a drill. In this embodiment, notch portion 313 receives the bulk of the driving force from the drill. The driving force is delivered to the rest of the stake and, ultimately, end 314 because stake 310 is a rigid body. Pilot 312 is also used to secure a line to stake 310.

Turning the stake/adaptor system places a stress particularly on the connection between the key notch of the adaptor and the notch portion of the stake. Extra support may be added to one or both of these parts to strengthen the connection. This extra support can be added in the form of thickness at that site on both parts. In more supported embodiments, a sleeve of a stronger material is added to the notch portion and a plate of a stronger material is added to one or both of the key notch sides. One side of the key notch experiences the stress when the stake is driven into the ground while the other side of the key notch experiences the stress when the stake is back-driven out of the ground. The side experiencing stress during driving into the ground will experience the greater stress, so added strength is preferable for this side if only one side is strengthened.

Figure 3C:
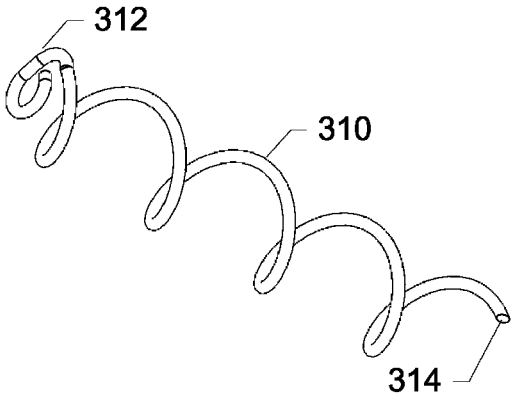
FIG. 3C shows an isometric view of a stake, according to an exemplary embodiment of the present invention.

FIG. 3C shows an isometric view of a stake 310, according to an exemplary embodiment of the present invention. Stake 310 includes a pilot 312 and an end 314. In this view, the coil shape of stake 310 is more clearly seen. End 314 of stake 310 preferably comes to a point to ease penetration of the ground.

There are many ways to make a stake suitable for insertion into the adaptor. The pilot must be designed to fit the stake receiver of the adaptor. Many different shapes can be used in the stake receiver and the pilot, so long as the shapes match. In one exemplary embodiment, the stake, including the pilot, is manufactured by bending a single wire.

Figure 4:
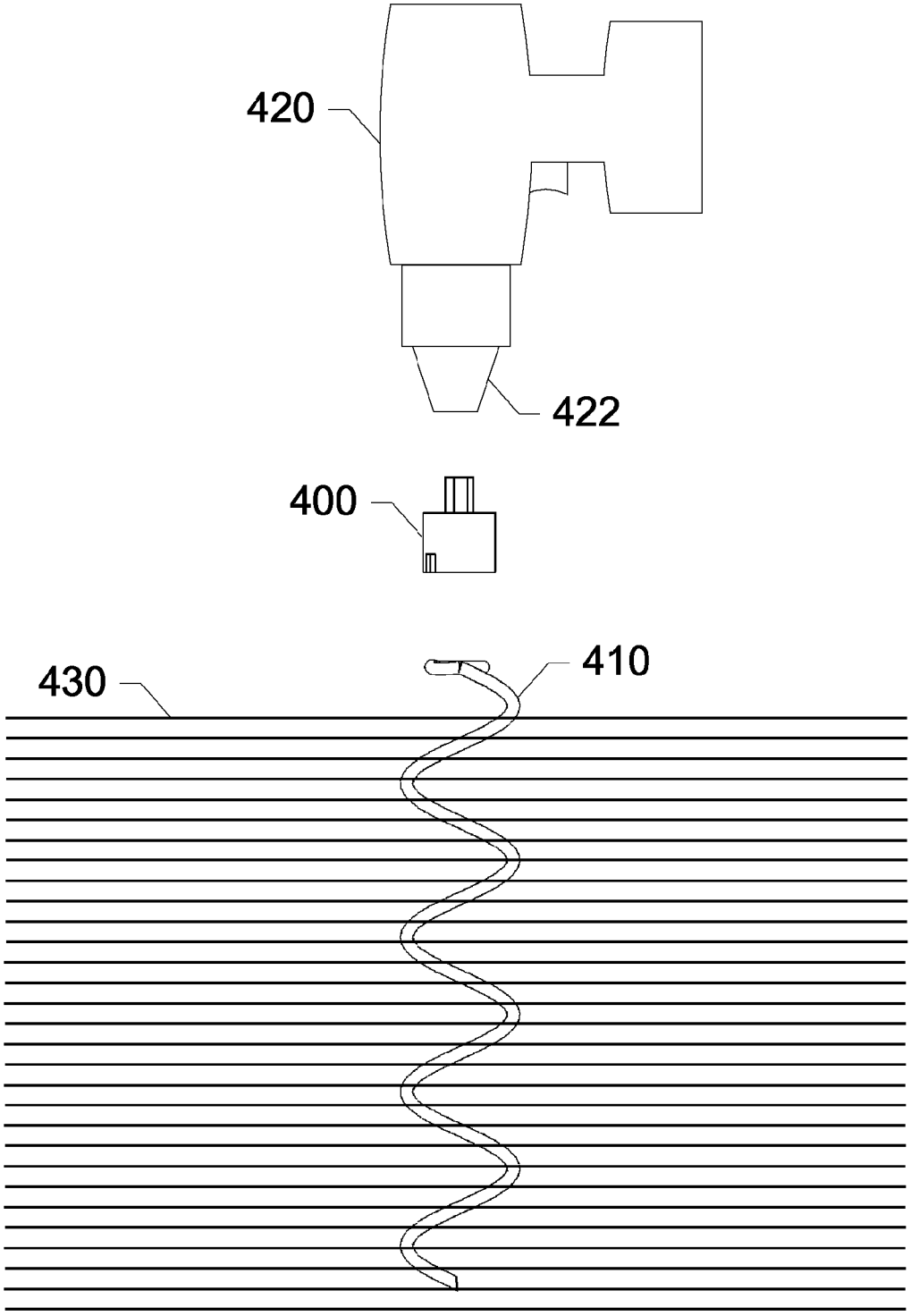
FIG. 4 shows a system for twisting a coil stake into the ground using a drill, according to an exemplary embodiment of the present invention.

FIG. 4 shows a system for twisting a coil stake into the ground using a drill, according to an exemplary embodiment of the present invention. The system includes a drill 420 having a chuck 422, an adaptor 400, and a stake 410. Chuck 422 of drill 420 is fitted with adaptor 400. Stake 410 is then inserted into adaptor 400, so that drill 420, adaptor 400, and stake 410 are all attached. In this configuration, when drill 420 is activated, chuck 422, adaptor 400, and stake 410 all rotate in unison. The assembly of drill 420, adaptor 400, and stake 410 is positioned so that the free end of stake 410 is at the top of a ground 430 and drill 420 is directly overhead. Drill 420 is activated and pushed down by the user at the same time. The downward force may not be necessary in all cases, but can help in some. As the stake is rotated, it is driven into ground 430. This driving process continues until the stake is substantially into ground 430. To remove stake 410 from ground 430, drill 420 is placed in reverse. Reverse is a common feature in most power drills today.

Figure 5:
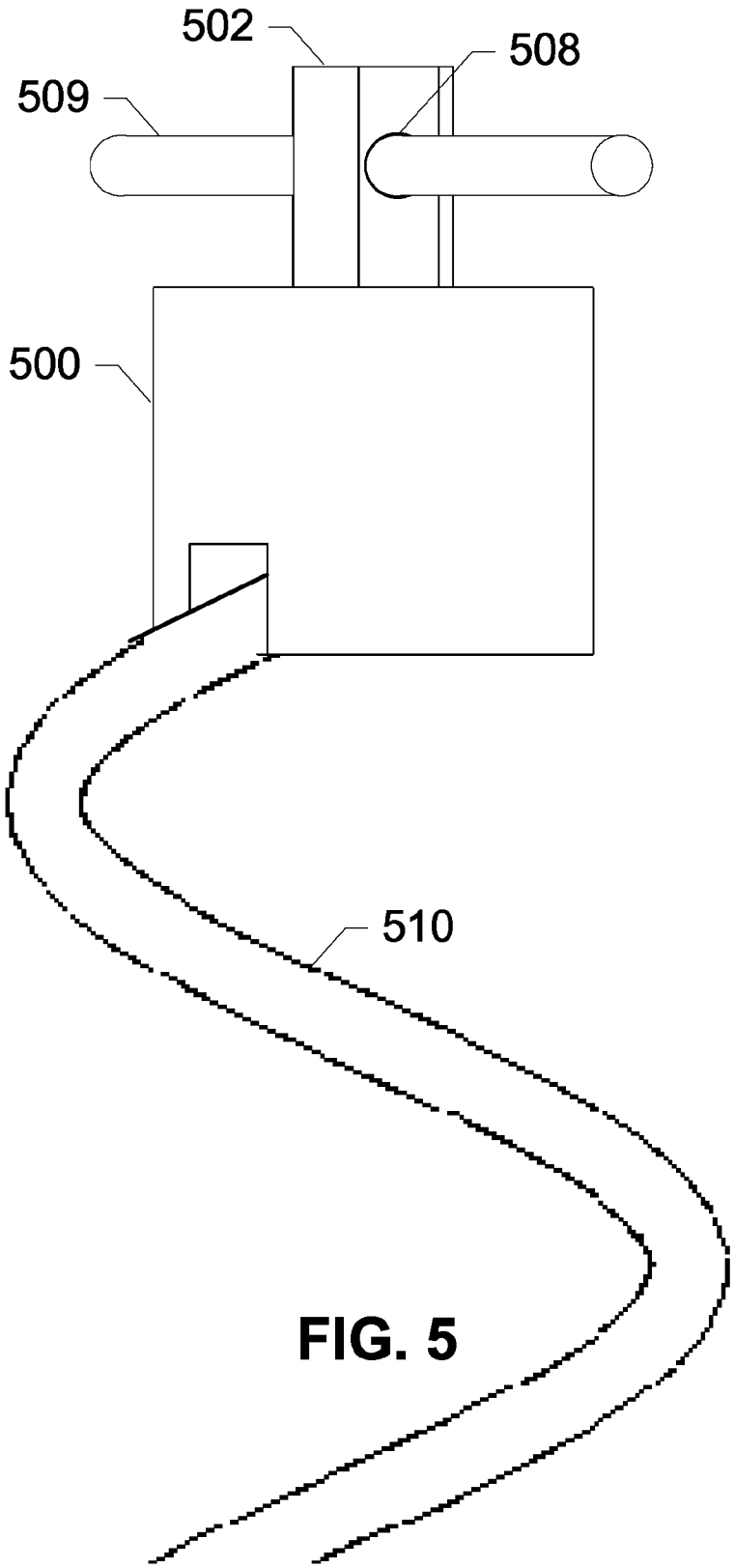
FIG. 5 shows an adaptor for fitting a stake and a handle, according to an exemplary embodiment of the present invention.

In other embodiments, other drills are used, such as powered screw-drivers, DREMEL tools, or anything else that rotates. Each of these devices may have vastly different connecting points. However, embodiments of the present invention accommodate each connection type. In a powered screwdriver embodiment, the adaptor has an indentation to match the screw type: a cross indentation for a PHILLIPS head screw driver, and a trench indentation for a flat head screw driver. For each embodiment of the drill, an adaptation on top of the adaptor is formed to match. To connect other drills, other embodiments of the adaptor will become apparent to those having skill in the art upon reading this disclosure FIG. 5 shows an adaptor 500 for fitting a stake 510 and a handle 509, according to an exemplary embodiment of the present invention. Adaptor 500 includes a drill insert 502, a handle throughbore 508, and handle 509, and fits stake 510. In the event that stake 510 needs to be driven, but there is no drill or no power, stake 510 must be hand driven. Since stake 510 has a coil shape, applying a downward force will not be the most effective method. Handle throughbore 508, which is a hole cut through drill insert 502, allows handle 509 to run through drill insert 502. Handle 509 provides torque leverage for a user to manually turn adapter 500 and stake 510. Handle 509 is strong enough to withstand the force of turning stake 510, and long enough to provide enough torque advantage for a user to turn stake 510.

In other embodiments, the handle is lengthened or shortened. A longer handle can provide more torque advantage, but must also be stronger. A larger handle throughbore allows for a thicker, stronger handle. However, a larger handle throughbore may weaken the drill insert. Depending on the application, suitable throughbore size will become apparent to those having skill in the art upon reading this disclosure.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device for securing a stake into the ground, the device comprising:

an adaptor attachable to a drill;

a stake receiver coupled with the adaptor, the stake receiver having a key notch extending through an outer wall of the stake receiver;

a stake insertable into the stake receiver, the stake having a first end insertable into the ground, and a second end having a pilot insertable into the stake receiver, the pilot sized to fit within the outer wall of the stake receiver, the pilot being proximal to a notch portion which is sized to extend through the key notch such that the stake is axially locked with the adaptor, the notch portion having extra support;

wherein the drill turns the adaptor and the stake in unison on an axis of rotation.

2. The device in claim 1, wherein the stake is made from a single wire that is bent into shape.

3. The device in claim 2, wherein the coil shape has a variable pitch, a variable diameter, and a variable coil length.

4. The device in claim 1, wherein the stake has a coil shape.

5. The device in claim 1, wherein the adapter further comprises a drill insert.

6. The device in claim 1, further comprising a handle throughbore, the handle throughbore being parallel to the axis of rotation.

7. The device in claim 6, further comprising a handle attachable to the adaptor through the handle throughbore.

8. A system for securing a stake into the ground, the system comprising:

a drill;

an adaptor attachable to the drill;

a stake receiver coupled with the adaptor, the stake receiver having a key notch extending through an outer wall of the stake receiver;

a stake attachable to the stake receiver, the stake being a coil having a first end insertable into the ground, and a second end having a pilot attachable to the stake receiver, the pilot sized to fit within the outer wall of the stake receiver, the pilot being proximal to a notch portion which is sized to extend through the key notch such that the stake is axially locked with the adaptor, the notch portion having extra support;

wherein the drill turns the adaptor and stake in unison on an axis of rotation.

9. The system in claim 8, wherein the stake is made of steel.

10. The system in claim 8, wherein the adapter includes a drill insert.

11. The system in claim 10, wherein the drill includes a chuck.

12. The system in claim 11, wherein the chuck receives the drill insert to lock the adaptor to the drill.

13. The system in claim 8, wherein the adaptor includes a handle throughbore, the handle throughbore being parallel to the axis of rotation.

14. The system in claim 13, further comprising a handle attachable to the adaptor through the handle throughbore.

* * * * *